US008720342B1

(12) United States Patent
Gold et al.

(10) Patent No.: US 8,720,342 B1
(45) Date of Patent: May 13, 2014

(54) LOW COLLATERAL DAMAGE FRAGMENTATION WARHEAD

(75) Inventors: Vladimir M. Gold, Hillside, NJ (US); Henry Hsieh, Riverdale, NJ (US)

(73) Assignee: The United States of America as Represented by the Secretary of the Army, Washington, DC (US)

( * ) Notice: Subject to any disclaimer, the term of this patent is extended or adjusted under 35 U.S.C. 154(b) by 0 days.

(21) Appl. No.: 13/461,242

(22) Filed: May 1, 2012

Related U.S. Application Data

(63) Continuation-in-part of application No. 12/729,485, filed on Mar. 23, 2010, now abandoned.

(51) Int. Cl.
*F42B 12/22* (2006.01)
*F42B 12/32* (2006.01)

(52) U.S. Cl.
USPC ..... 102/495; 102/496

(58) Field of Classification Search
USPC ..... 102/475, 489, 491, 492, 493, 494, 495, 102/496, 473, 478
See application file for complete search history.

(56) References Cited

U.S. PATENT DOCUMENTS

| | | | | |
|---|---|---|---|---|
| 3,491,694 | A * | 1/1970 | Fountain | 102/493 |
| 3,954,060 | A * | 5/1976 | Haag et al. | 102/494 |
| 3,970,005 | A * | 7/1976 | Rothman | 102/492 |
| 4,312,274 | A * | 1/1982 | Zernow | 102/493 |
| 4,745,864 | A * | 5/1988 | Craddock | 102/491 |
| 4,823,701 | A * | 4/1989 | Wilhelm | 102/492 |
| 5,131,329 | A * | 7/1992 | Lips et al. | 102/364 |
| 5,229,542 | A * | 7/1993 | Bryan et al. | 102/491 |
| 5,337,673 | A * | 8/1994 | Koontz et al. | 102/491 |
| 8,408,139 | B2 * | 4/2013 | Baumann et al. | 102/491 |
| 8,413,585 | B2 * | 4/2013 | Heitmann | 102/476 |
| 2012/0291654 | A1 * | 11/2012 | Wilson et al. | 102/492 |

* cited by examiner

*Primary Examiner* — James Bergin
(74) *Attorney, Agent, or Firm* — Michael C. Sachs

(57) ABSTRACT

A fragmentation warhead includes a cylindrical body, and an explosive charge disposed within the innermost part of the warhead body comprised of slidable positionable explosives, their times of detonation controllable by an operator. The apparatus can produce numbers and sizes of fragments ranging from relatively large to relatively small.

5 Claims, 4 Drawing Sheets

LOW COLLATERAL DAMAGE FRAGMENTATION WARHEAD

CROSS REFERENCE TO RELATED APPLICATIONS

This application is a continuation-in-part of application Ser. No. 12/729,485 filed Mar. 23, 2010 now abandoned, the entire file wrapper contents of which are hereby incorporated by reference herein as though fully set forth.

U.S. GOVERNMENT INTEREST

The inventions described herein may be made, used, or licensed by or for the U.S. Government for U.S. Government purposes.

BACKGROUND OF INVENTION

Warhead fragmentation effectiveness is determined by the number, mass, shape, and velocity of the warhead's fragments. By using a controlled fragmentation design, warhead fragmentation can generally be achieved quickly and in a cost effective manner. Exemplary controlled fragmentation techniques are described in U.S. Pat. Nos. 3,491,694; 4,312,274; 4,745,864; 5,131,329; and 5,337,673.

Conventional designs in general use "cutter" liners that form fragments by generating a complex pattern of high-velocity "penetrators" for fragmenting the shell. Although these conventional fragmentation designs have proven to be useful, it would be desirable to present additional functional, cost and safety improvements that minimize the warhead weight, reduce manufacture expenses, and are less sensitive to unintended explosions. Explosive type fragmentation devices may be seen in U.S. Pat. No. 4,823,701 to Earl E. Wilhelm; in U.S. Pat. No. 3,970,005 to Mathew Rothman; and in U.S. Pat. No. 3,954,060 to Haag et al, the entire file wrapper contents of which patents are hereby incorporated by reference as though fully set forth.

What is needed in this field is an inexpensive warhead which in addition provides the user an ability to select in advance, the degree of fragmentation, and sizes of fragmentation, for particular targets. According to one embodiment of the present invention, a warhead includes a liner that is disposed inside the warhead body, filled with the warhead's explosive, such allowing the detonation shock wave to directly propagate into the fragments. As a result, the explosion produces a complex pattern of shear planes in the warhead body, causing shell break-up and release of fragments with predetermined sizes. This design is distinguishable from existing fragmentation liner technologies that attempt to score or cut the warhead body. One of the advantages of the present embodiment compared to existing technologies is the cost effectiveness of the manufacturing process of the present design, in that it is faster and more economical to fabricate, as opposed to notching or cutting a steel warhead body itself.

SUMMARY OF INVENTION

The present invention satisfies these needs, and presents a munition or warhead as part of a projectile and an associated method for generating diverse fragmentation patterns. The invention relates to explosive fragmentation ammunition with target-adaptable fragmentation output, and more particularly, to a warhead having means for selectively controlling the number of fragments that range from the full to the lower, lethality level. According to an embodiment of the invention, the target-adaptable fragmentation output is achieved by means of a dual purpose explosive/propellant charge that ejects a main high explosive charge from a fragmentation case, thus changing the extent of the contact area between the explosive charge and the case, and consequently the degree of case fragmentation. This provides a user with an ability to select in advance, the degree of fragmentation, and sizes of fragmentation, for particular targets.

OBJECTS OF THE INVENTION

It is an object of the present invention to provide a fragmentation warhead where relative fragment quantity and fragment sizes can be selected by the user, and;

It is another object of the present invention to provide a fragmentation warhead utilizing propellant which directs relative sliding of a high explosive through a fragmentation case in the warhead to affect relative fragment quantities released from such warhead, and;

It is a still further object of the invention to provide a fragmentation warhead utilizing dual propellant-high explosive to affect fragmentation of a fragmentation case in a warhead for producing a relative fragment quantity.

These and other objects, features and advantages of the invention will become more apparent in view of the within detailed descriptions of the invention and in light of the following drawings. It should be understood that the sizes and shapes of the different components in the figures may not be in exact proportion and are shown here for visual clarity and for purpose of explanation.

DETAILED DESCRIPTION

Figure 1:
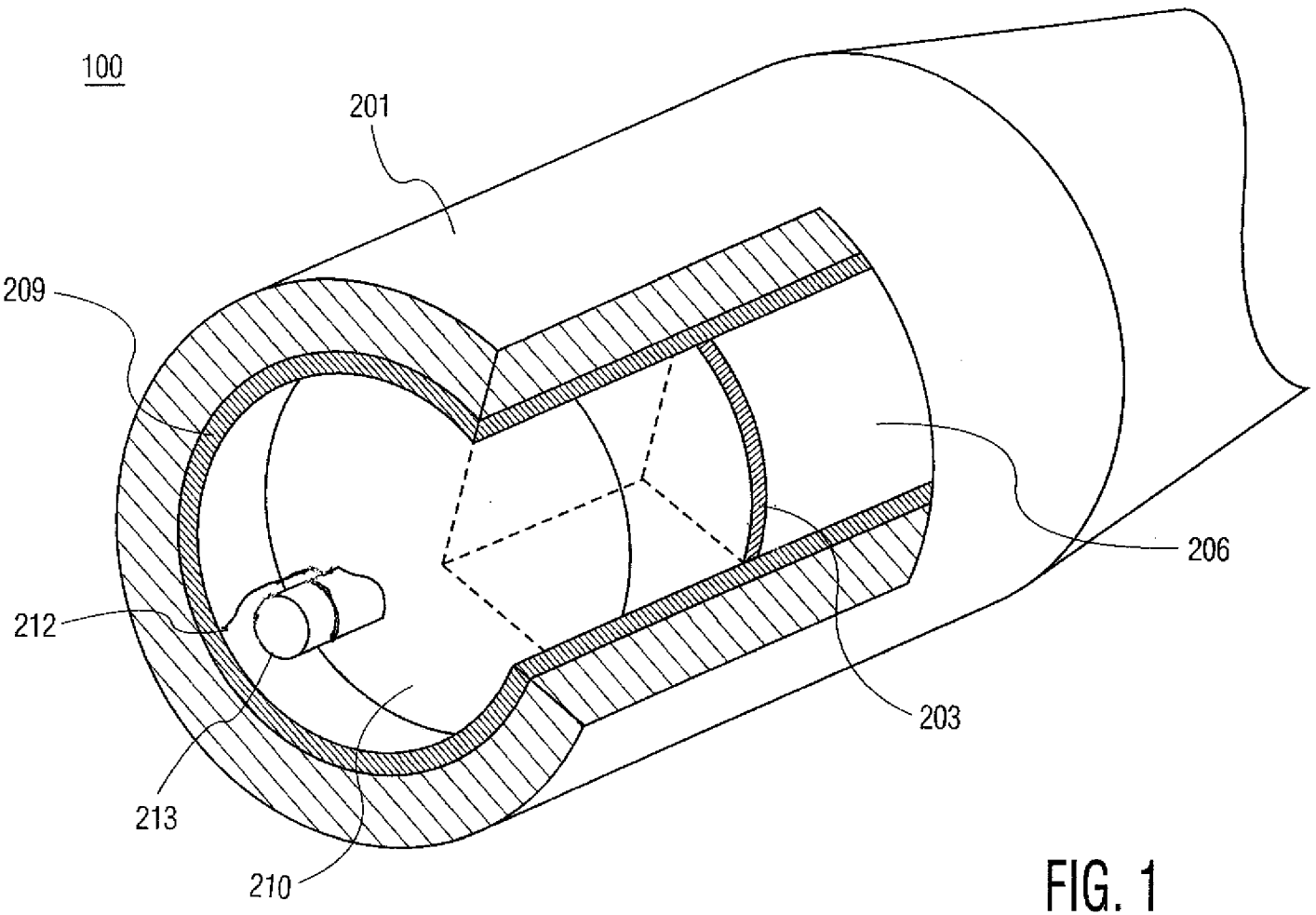
FIG. 1 shows a cutaway view of a fragmentation warhead system made in accordance with this invention.
Figure 2A:
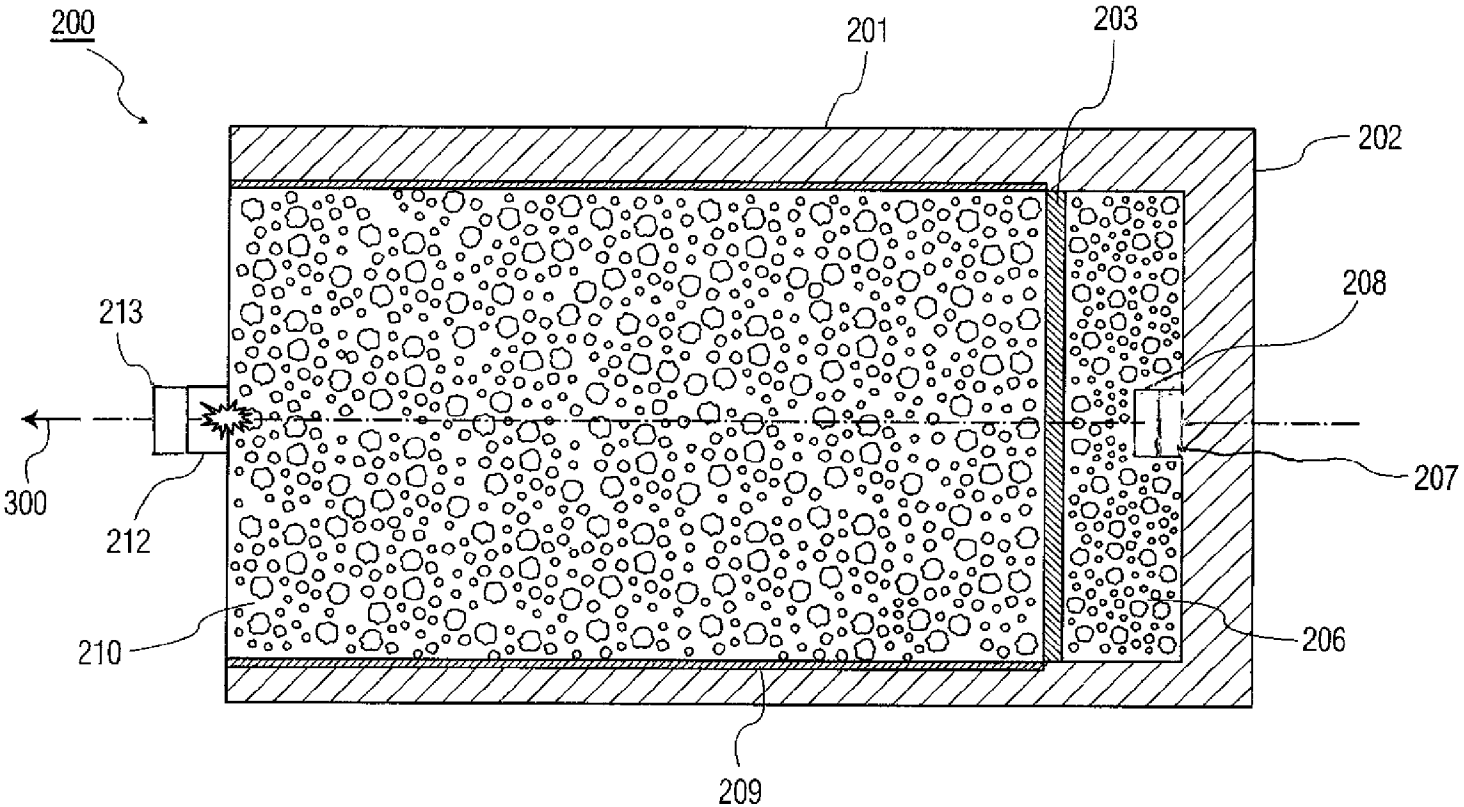
FIG. 2A shows a cross section of the warhead according to FIG. 1, where the warhead is in full fragmentation desired mode.
Figure 2B:
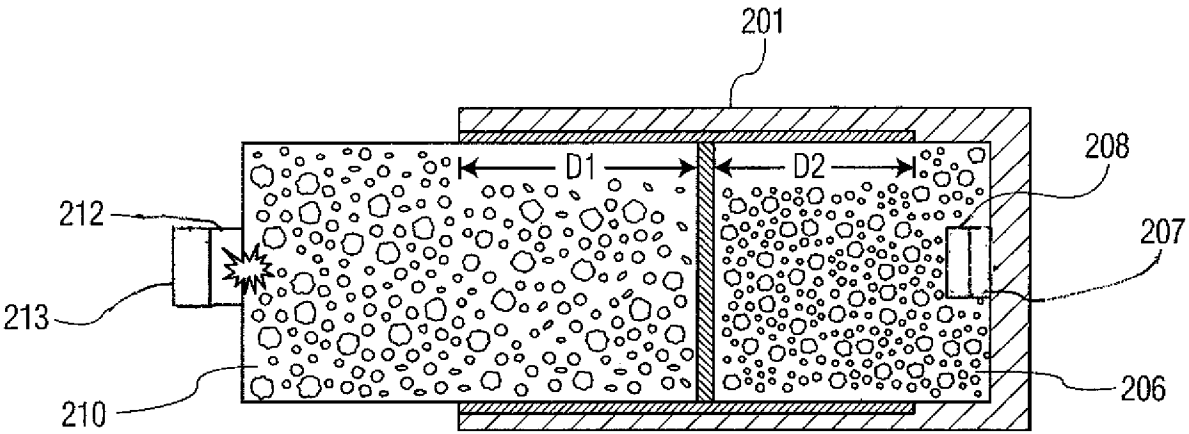
FIG. 2B shows a cross section of the warhead according to FIG. 1, where the warhead is in a partial fragmentation desired mode.
Figure 2C:
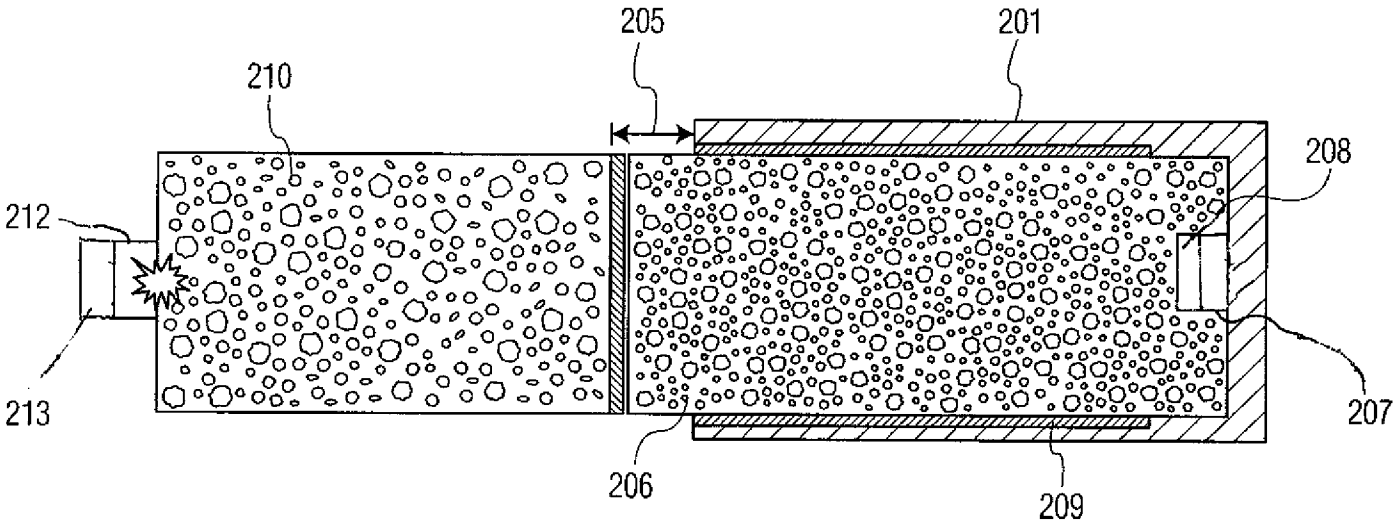
FIG. 2C shows a cross section of the warhead according to FIG. 1, where the warhead is in a non fragmentation desired mode.

FIGS. 1, 2A-2C illustrate an exemplary warhead, projectile, shell, munition, explosively formed projectile, or shaped charge liner, etc., (referenced herein as warhead 100), utilizing a dual explosive controlled fragmentation of a fragmentation case according to the present invention. Warhead 100 generally comprises fragmenting case 201 which has a closed end 202 (the other end being open), dual propellant-explosive charges 210, 206 as taught in FIGS. 2A-2C, hollow cylindrically shaped liner 209 which permits free lateral movement therein in either direction of a sliding thermal insulation (or pushing plate) wall 203, back plates (not completely shown), and initiation mechanism assemblies (not completely shown). The warhead 100 and fragmenting case 201 preferably take on a cylindrical shape. Detonation wave barrier wall 203 can be made from axially adjacent, alternating layers of high shock impedance material like plastic or Plexiglas, and then low shock impedance material of a lighter weight material like aluminum. FIGS. 2A-2C apparatus can produce fragments ranging from relatively large numbers of fragments to relatively small numbers of fragments. Large numbers of fragments would be desirable for defeating more heavily armored targets, while a smaller number of fragments could be used for lightly armored or soft targets. There is also the possibility of producing larger versus smaller fragment sizes themselves, this done by locating fragments by their size along and within the fragmenting case as desired, when the case is first manufactured. The larger sized fragments would be set more towards the closed end of the fragmenting case whereas the smaller sized fragments would be set more towards the open end of the fragmenting case. Half the case with large fragments near the closed end and the other half case with small fragments near the open end, might be a suitable choice. Thus when the case fragments, these larger fragments would be released towards the closed end while these smaller fragments would be released towards the open end. Large size fragments (2 or 3 grains, e.g.), would be desirable for defeating more heavily armored targets, while smaller size fragment (less than 1 grain) might be applicable for lightly armored or soft targets. Consequently, the structure efficiently enables variable fragmentation and lethality of the warhead that can range from maximum lethality for more heavily armored targets to a maximum lethality for lightly armored or soft targets. The fragments in the fragmentation case can be made, e.g., from tungsten alloyed with copper and/or nickel. (It should be appreciated that the respective sizes of the warhead housing, thicknesses, lengths, and/or diameters are not precisely to scale in these drawings). In the examples shown in FIGS. 2A-2C, an entire warhead system 200 is moving in direction 300 towards point-precision engagement with an intended target. In full fragmentation mode, FIG. 2A, the HE high explosive 210 is detonated (through ignition means 212 initiated through fuze means 213, e.g., not completely shown). The fuze means described 213 acts by producing a flame or great heat through use of mechanical safe-arm devices or better (lighter) in conjunction with a hot bridge wire or an exploding bridge wire generating single-point initiation. The heat (or flame, if present) ignites a secondary explosive train, which could be a pellet, or better of any well known propellants such as PETN, along a line or surface. Thus, the PETN would be used as the booster for the detonator on the main explosive charge. Detonation causes fragmentation of (liner 209 and) fragmentation case 201, into a large number of large sized fragments. In the partial fragmentation mode, FIG. 2B, a (dual explosive) propellant charge 206 is first detonated (by ignition means 208 initiated through fuze means 207, e.g., not completely shown). This causes wall 203, the thermal insulation pushing plate, to slide along within low friction liner 209 in direction of travel (300), a distance D2 in direction 300, thus pushing along the (solid piece) main explosive charge 210 within liner 209 (in turn located within fragmenting case 201), all while the entire warhead system 200 continues to acquire additional momentum in direction 300 and continues to move towards engagement with an intended target. Next, the high explosive 210 is timed to be then next detonated at a desired fragmentation lethality level, (when D2 versus D1 is at a desired prearranged proportion). The greater D2 is, the more of fragmentation case 201 is ultimately fragmented, and hence the more resulting fragments thereof will result. The pre-established distance proportions were derived through trial and error experimentation. When functioning in the low collateral damage mode of FIG. 2C, using ignition means 208 initiated by fuze means 207, e.g., (not completely shown), the propellant charge 206 would be detonated first. As a result, the pressurized combustion gases push the thermal insulation pushing plate 203 to slide within low friction liner 209 in direction of travel (300), eventually pushing (solid piece) main explosive charge 210 entirely out of, and away from the fragmenting case 201. The HE high explosive 210 is then detonated (through ignition means 212 initiated through fuze means 213, e.g., not completely shown) when the explosive 210 is then already separated from the explosive by at least an air gap 205. Such detonation of main explosive 210 therefore produces no fragmentation of case 201, only a limited-area near-field lethality air blast moving in direction of travel 300 with rapidly decreasing far-field lethality and a minimizing of collateral damage, for example, to bystanders. The HE explosive charge 210 depending on which mission is desired could comprise for example, LX-14, OCTOL, hand packed C-4, or other similar solid explosives that can be machined, cast, or hand-packed to fit snugly but to be able to slide within the inside of liner 209 as was mentioned. Charge 206 on the other hand, can be a conventional propellant such as JA-2 (which is intended to be a less powerful explosive than 210). A newer dual propellant explosive such as RASP-3 MTOP now exists which might in the future be actually used for both 206 and for 210 if properly adapted with the required initiation mechanisms and with suitable timing. The method of initiating detonations (though not completely shown here) is as follows.

While the invention has been described with reference to certain embodiments, numerous changes, alterations and modifications to the described embodiments are possible without departing from the spirit and scope of the invention as defined in the appended claims, and equivalents thereof.

What is claimed is:

1. A fragmentation warhead which comprises: a cylindrical fragmentation case having a closed end and an open end, a liner within said fragmentation case, a heat insulated wall which is able to slide laterally within said liner, a propellant charge disposed within said liner between said wall and said fragmentation case closed end, and a high explosive charge disposed within said fragmentation case between said wall and said fragmentation case open end, said fragmentation warhead further comprising a propellant charge initiation means comprising a fuze means to initiate a PETN explosive train to fire a propellant charge detonation means, and; a high explosive charge initiation means comprising a fuze means to initiate a PETN explosive train to fire a high explosive charge detonation means.

2. The fragmentation warhead of claim 1 wherein said propellant initiation means is activated so that said wall is moved a first distance (D2) away from the closed end of said fragmentation case along the inside of the liner whereupon said high explosive charge initiation means is then first activated, this to only partially fragment the fragmentation case between the wall and the open end of said fragmentation case.

3. The fragmentation warhead of claim 2 wherein approximately half of the fragmentation case measured from the case open end is comprised of relatively small size fragments.

4. The fragmentation warhead of claim 3 used for defeating a light armored or soft target.

5. The fragmentation warhead of claim 4 wherein said relatively small size fragments are approximately 1 grain.

* * * * *